United States Patent [19]

Seaman

[11] 4,277,859

[45] Jul. 14, 1981

[54] TRAVEL PILLOW

[76] Inventor: Florence Seaman, 1039 Cecile Dr., Port Moody, Canada, V3H 1M5

[21] Appl. No.: 59,416

[22] Filed: Jul. 20, 1979

[51] Int. Cl.[3] ..... A47C 27/08

[52] U.S. Cl. ..... 5/434; 5/413; 5/420; 5/453; 150/11

[58] Field of Search ..... 5/413, 416, 417, 420, 5/440–499, 453–455, 490, 434, 4; 150/11

[56] References Cited

U.S. PATENT DOCUMENTS

| | | | |
|---|---|---|---|
| 918,391 | 4/1909 | Taarad | 5/441 |
| 3,204,678 | 9/1965 | Worcester | 5/441 |
| 3,411,164 | 11/1968 | Sumergrade | 5/441 |

*Primary Examiner*—Casmir A. Nunberg
*Attorney, Agent, or Firm*—Robert D. Farkas

[57] ABSTRACT

A traveling pillow is described including an inner rubber inflatable pillow, an intermediate fiber-filled case for said pillow, and an exterior slip cover having a carrying handle. The carrying handle is provided with a compartment for storage of a small pneumatic pump for the inflatable pillow. A compact carrying case is also provided to store and carry the pillow in deflated rolled-up form.

3 Claims, 4 Drawing Figures

TRAVEL PILLOW

BACKGROUND OF THE INVENTION

1. The Field of the Invention

As is well known it has become popular in recent years for many people to travel long distances by bus or other public conveyances. In so doing, it is necessary for them to spend many hours, sometimes days and even weeks more or less confined to a single seat in the vehicle. This necessitates provision for comfort, particularly at night or during rest periods to permit the passenger to sleep. While the airlines have for some time provided small pillows for the comfort of their passengers, this has not been customary among the bus lines whose passengers are generally confined aboard the vehicle for even longer periods of time than air travelers. For these reasons it is apparent that a need has long existed for a comfortable and convenient travel pillow.

2. Description of the Prior Art

The prior art has not, surprisingly enough, devoted much attention to this problem. To be sure, inflatable cushions are known, as disclosed in Klepper U.S. Pat. No. 2,987,114, issued June 6, 1961, which describes air cushions particularly adapted to be detachably connected to boat seats or used as back rests or life preservers.

More pertinent to the present problem is Porter U.S. Pat. No. 2,682,918 issued July 6, 1954 for a general purpose air cushion adapted for use as a seat cushion, head or back rest. These air cushions comprise a pair of hollow inflatable cushion sections, each having a front wall and a back wall, means joining the back wall of one section to the front wall of the other section over an area, valve means in the wall of one of the inflatable sections to provide for the introduction of air into said section, and means establishing communication between said inflatable sections, said means including a hole through said joined back and front wall within said area, thus providing a double air cushion.

Diamond U.S. Pat. No. 3,644,949 issued Feb. 29, 1972, describes an air inflatable cushion having a plurality of separately inflatable sections each superposed one above the other and each having diverse thickness front to back when inflated. The several sections also have differing average thickness so that when selectively inflated a total cushion of various heights and shapes is provided to accommodate the various parts of the body as desired.

Stamberger U.S. Pat. No. 3,898,703 issued Aug. 12, 1975 describes an inflatable cushion having means for increasing the air pressure in the cushion by the use of folding elements.

Schick U.S. Pat. No. 3,222,694 issued Dec. 14, 1964 describes a portable seat cushion. Winkler U.S. Pat. No. 3,308,489 issued Mar. 14, 1967 describes a cushion for resting the legs. Howard U.S. Pat. No. 3,253,861 issued May 31, 1966 describes an inflatable cushion for use as a back rest and having provision for ventilation.

Sumergrade U.S. Pat. No. 3,411,164 issued Nov. 19, 1968 describes a pillow having a plurality of divider panels forming separate compartments. An inflatable member is disposed within the casting and a filling material is disposed between the inflatable member and the fabric cover. In this pillow the inflatable member is positioned in a central compartment normally beneath the user's head, whereas the side compartmentsare stuffed with inexpensive filler, since they are not usually involved in the sleeper's comfort.

It should be apparent from the foregoing that the art has previously given little or no attention to the provision of pillows especially adapted for the comfort and convenience of travelers.

SUMMARY OF THE INVENTION

A primary object of the present invention is to provide a comfortable and convenient travel pillow.

Another object of the present invention is to provide a travel pillow which is convenient to carry when not in use.

Still another object of the present invention is to provide a large and commodious travel pillow which can be reduced in size and stored and carried in a smaller carrying case when not in use.

Yet another object of the present invention is to provide in combination in a travel pillow an inner inflatable pillow, an intermediate fiber-filled casing for the inflatable pillow, an outer slip cover, and carrying means including a pneumatic pump for the inflatable pillow.

The foregoing and other objects of the invention which will become apparent hereinafter are attained by providing a novel combination pillow and carrying case therefor. The pillow, when in use is of a comfortable size such as 16" by 23" and is composed of an inner inflatable pillow of suitable size of rubber or rubber-like material having conventional valve and stem means to permit inflation either by mouth or by pneumatic pump. An intermediate fiber filled casing is provided over the inflatable pillow. This casing may consist of inner and outer fabric envelopes with fibrous filling therebetween. The fibrous filling may be of any suitable type, either natural or synthetic, e.g. cotton or synthetic batting, sheeps wool, down, feathers, kapok or the like. The casing is preferably in the form of an envelope having three closed sides and one open side into which the inflatable pillow may be inserted. If desired, the intermediate casing may have a pocket on the external surface thereof to provide storage for the deflated inflatable pillow when not in use. This pocket may also be useful for hiding currency or traveler's checks or the like since it is normally out of sight.

An exterior slip cover of hard wearing but attractive material is provided to enclose the intermediate casing. This exterior cover may be closed by means of a zipper, snap fasteners or the recently developed interlocking fabric closures which are stuppably adherent to each other, or by any other suitable means. This exterior cover is provided with a suitable strap handle for carrying the pillow in its in use form. This handle may be provided with a suitable compartment, closed by a zipper or otherwise to provide storage for a small portable pneumatic pump of the type, but smaller than those normally used for bicycle tires.

The pillow, when not in use, may be reduced in size and stored and carried in a separate compact storage unit. This is done by deflating the inflatable pillow by use of its valve, and rolling or folding the pillow so as to substantially reduce its size. The rolled pillow is then inserted in the compact carrying case which may be closed by a suitable flap or cover with a fastening means. A strap or other suitable handle is provided on the compact carrying case. This strap or handle may fit the hand or may be made larger to permit carrying from the shoulder.

These objects as well as other objects of the present invention, will become more readily apparent after reading the following description of the accompanying drawings.

DESCRIPTION OF THE PREFERRED EMBODIMENT

Figure 1:
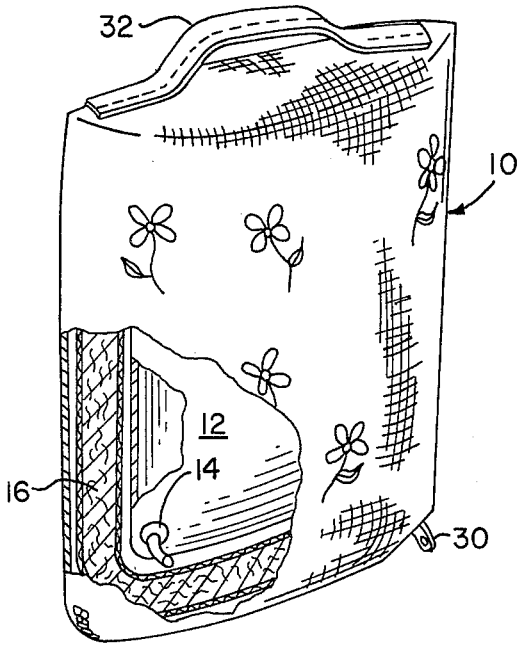
FIG. 1 is a perspective view of the travel pillow in its in use mode.
Figure 2:
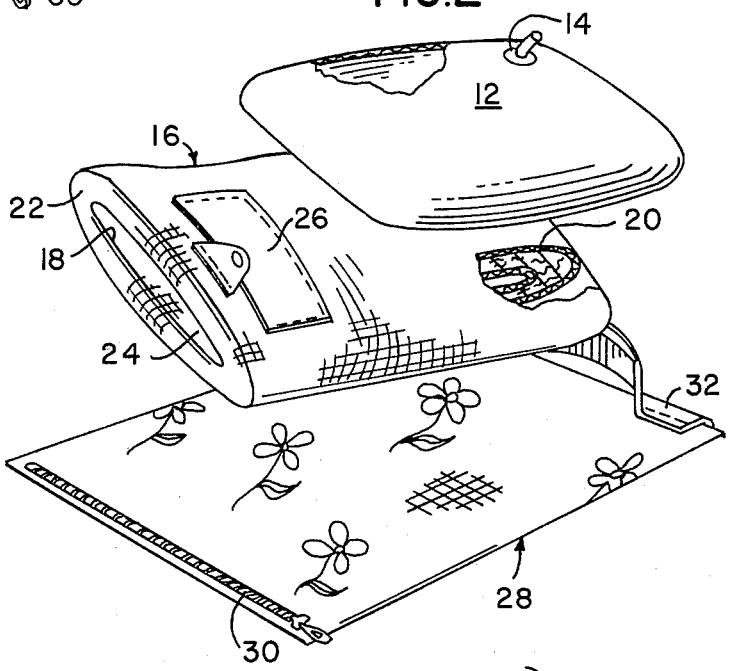
FIG. 2 is an exploded view showing the inner inflatable pillow, the intermediate fiber-filled casing and the exterior slip cover.

A preferred embodiment of the present invention is shown in the accompanying drawing in which the travel pillow is generally indicated in its full in use mode by numeral 10. The travel bag includes a rubber or rubberized and inflatable inner pillow 12 having a pneumatic valve and stem 14 of conventional type. An intermediate casing 16 is composed of inner and outer fabric envelopes 18 and 20, respectively, enclosing therebetween a substantial layer of fiber fill 22. This fiber filling may be in the form of a bat or blanket and serves not only to insulate the inner rubber inflatable pillow but to cushion and soften the rubber casing thereof which is generally less pleasing to the user's head or ear. The intermediate casing is preferably closed on three sides but has one opening at 24 to permit insertion of the inflatable pillow 12. The intermediate casing may be made of any suitable durable fabric. A pocket 26 may be provided on the intermediate casing 16 for secreting currency or traveler's checks or other valuables or, if desired, for storing the deflated inner pillow 12 when not in use.

An exterior slip cover 28 of attractive but very durable and washable fabric is provided with one open end and a suitable closure therefor, zipper 30. The intermediate fiber-filled casing 16 containing the inflatable pillow 12 is disposed within the exterior slip cover 28 as shown in FIG. 1. A strap 32 or other suitable carrying handle is provided to carry the travel pillow in its fully sized in use mode.

Figure 4:
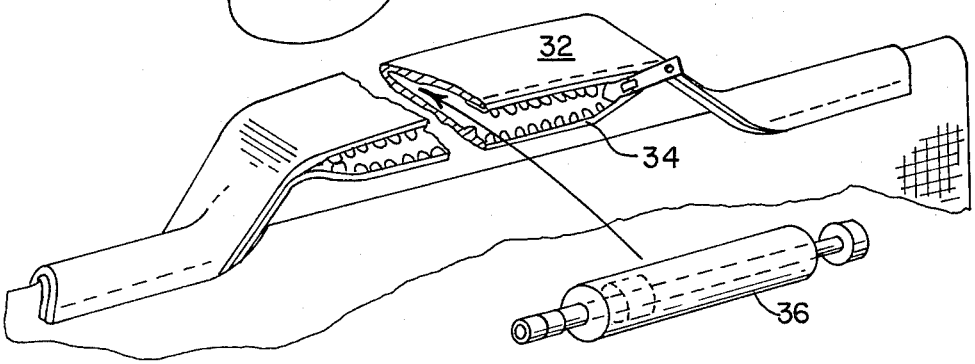
FIG. 4 is a detail view of the exterior slip cover showing a compartment in the handle thereof for a pneumatic pump.

As seen in FIG. 4, the handle 32 may be provided with a compartment 34 closed by a zipper or other suitable means for a small pneumatic pump 36.

Figure 3:
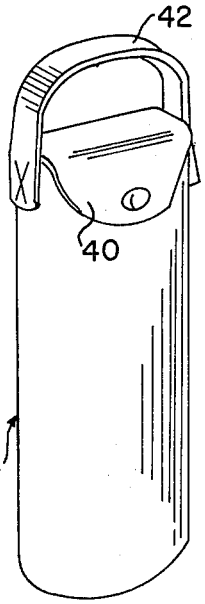
FIG. 3 is a perspective view of the compact storage and carrying unit for the travel pillow.

While the travel pillow may be carried quite conveniently in its full size form as shown in FIG. 1, it is adapted to be carried in a more compact and still more convenient form as shown in FIG. 3. This is accomplished by deflating the pillow 12 and either leaving it in place in the opening 24 in casing 16 or by removing it and placing it in the pocket 26. In either case, the pillow 12, intermediate casing 16 and exterior slip cover 28 are then rolled up into as tight and compact a roll as possible and placed in the compact carrying case 38 shown in FIG. 3. This case has a flap closure 40 and handle 42. The handle 42 may be sized for the hand or may be made large enough for a shoulder strap. In this way, the bulk of the travel pillow is greatly reduced for convenience in carrying while sightseeing, shopping or visiting.

One of the advantages of the present invention is a comfortable and convenient travel pillow.

Another advantage of the present invention is a travel pillow which is convenient to carry when not in use.

Still another advantage of the present invention is to provide a large and commodious travel pillow which can be reduced in size and stored and carried in a smaller carrying case when not in use.

Yet another disadvantage of the present invention is to provide in combination in a travel pillow an inner inflatable pillow, an intermediate fiber-filled casing for the inflatable pillow, an outer slip cover, and carrying means including a pneumatic pump for the inflatable pillow.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiments of the invention in which an exclusive privilege or property is claimed are defined as follows:

1. A portable pillow for travelers comprising in combination an inner pneumatically inflatable removable bag, an intermediate fiber-filled casing for said inflatable bag, said intermediate casing being closed on three sides and having an opening in one end thereof to receive said inflatable bag and a separate exterior slip cover for said intermediate casing and inflatable bag, whereby in use said inflatable bag is placed within said intermediate casing which in turn is placed within said slip to provide said traveling pillow said casing having an outer covering and an inner covering and a substantial thickness of fibrous material between said outer and inner coverings thus providing an insulating and cushioning cover around said inflatable bag, said intermediate casing having a pocket on said outer covering thereof for the storage of said inflatable bag when deflated and not in use, a carrying case of more compact size than said pillow into which said bag may be fitted when deflated and rolled, said carrying case having a handle for carrying the same, a pneumatic pump, said pneumatic pump for inflating said inflatable bag, said handle of said carrying case having a compartment therein for removably storing said pneumatic pump therein.

2. A traveling pillow according to claim 1 wherein said inflatable bag is provided with a valve and stem device for inflating said bag.

3. A traveling pillow according to claim 1 wherein said exterior slip cover is also provided with a carrying handle for said pillow.

* * * * *